United States Patent [19]

Hoyland

[11] Patent Number: 4,537,005

[45] Date of Patent: Aug. 27, 1985

[54] BAG TYING MACHINE

[75] Inventor: Trevor B. Hoyland, Norwich, England

[73] Assignee: Thurne Engineering Co. Ltd., Norwich, England

[21] Appl. No.: 491,735

[22] Filed: May 5, 1983

[30] Foreign Application Priority Data

Jul. 20, 1982 [GB] United Kingdom ..... 8220925

[51] Int. Cl.[3] ..... B65B 51/06; B65B 51/08; B65B 61/02

[52] U.S. Cl. ..... 53/131; 53/138 A; 53/139.3; 53/417; 53/583

[58] Field of Search ..... 53/131, 138 A, 139.3, 53/417, 583; 156/522, 552; 83/267

[56] References Cited

U.S. PATENT DOCUMENTS

| | | | |
|---|---|---|---|
| 2,595,060 | 4/1952 | Dixon et al. | 53/583 |
| 2,841,935 | 7/1958 | Krueger | 53/583 |
| 2,916,863 | 12/1959 | Leighton et al. | 53/583 |
| 3,221,468 | 12/1965 | Casey | 53/583 |

FOREIGN PATENT DOCUMENTS

| | | | |
|---|---|---|---|
| 1389943 | 4/1975 | United Kingdom | 83/267 |
| 1487173 | 9/1977 | United Kingdom | 53/198 A |
| 1516499 | 7/1978 | United Kingdom | 53/483 |

*Primary Examiner*—Robert L. Spruill
*Assistant Examiner*—Michael D. Folkerts
*Attorney, Agent, or Firm*—Jeffers, Irish & Hoffman

[57] ABSTRACT

A machine for applying adhesive tape ties to filled bags comprises an adhesive tape path leading from an adhesive tape supply reel 1, manually movable accommodation means 6 which are located on one side of the adhesive tape path, which face the adhesive side of the adhesive tape 10, which accommodate the gathered together neck 40 of a bag, and which control its movement through the machine, an adhesive tape support 28 which is located on the other side of the adhesive tape path and which converges with and joins the adhesive tape path at a contact region 31 with substantially only line contact between them, a paper tape path leading from a paper tape supply reel 4 into contact with the adhesive tape path immediately downstream of the contact region 31 from the opposite side of the adhesive tape path, and a cutter 7 arranged to sever the adhesive 10 and paper 32 tapes to complete the tie. The machine is arranged so that in use, an operator urges the gathered together neck 40 of a filled bag against the adhesive side of the adhesive tape 10 and into the accommodation means 14, with continued manual movement of the gathered together neck 40 of the filled bag moving the accommodation means 6 and forming an adhesive tape tie around the neck of the filled bag. During this as further adhesive tape is drawn from the supply reel 1 and past the support 28 line contact only is established in the contact zone 31 between the adhesive side of the tape 10 and the support 28 to allow the bag and the accommodation means 6 to continue to move freely until the tapes 10 and 32 are severed.

9 Claims, 11 Drawing Figures

BAG TYING MACHINE

This invention relates to machines for tying bags with adhesive tape ties. It particularly relates to a machine which is capable of producing adhesive tape ties which include printed information on the tape, and paper tabs on the free ends of the tie to facilitate opening of the tie.

Our earlier British Patent Specification No. 1 381 871 and that of its patent of addition, No. 1 517 031, describe a machine for applying adhesive tape ties to bags at the downstream end of a bag-filling line. These patent specifications describe a machine which is capable of operating at a rate of up to 100 bags per minute. This machine holds a length of adhesive tape across the path of a closed neck of a bag so that as the bag is passed through the machine the length of tape folds around the closed neck of the bag with the adhesive side of the tape on both sides of the neck being urged together to complete the tie. The machine applies spaced lengths of paper tape to the adhesive tape upstream from the path of the bags through the machine and these spaced pieces of paper tape provide tabs at the free ends of the adhesive tape which enable the user to grasp these paper tabs to open the adhesive tape tie. Our British Patent Specification No. 1 516 499 describes how this machine can be modified so that it prints the adhesive tape with information with regard to the product packaged in the bag such as the price, the sell by date and its description. Such a machine has achieved considerable commercial success and, it is particularly useful in bakeries at the downstream end of a flow line for packaging sliced bread and cakes.

While this machine is ideal for a fully automated packaging line there is a need for a manually fed machine which is capable of working at a lower throughput of, for example, 10 to 20 packages per minute. Such a small machine would be particularly useful in small bakeries for packing cakes but naturally could be used for any other product.

One earlier proposal for such a machine is described in British Patent Specification No. 1 043 262 in the name of Minnesota Mining and Manufacturing Co. This patent specification describes two machines both of which produce adhesive tape ties having paper tabs at their free ends to facilitate their opening. The first example of machine that is described in this specification is a simple manually fed and operated machine and the second is a completely automatic machine that, like our earlier machine, is intended to operate at relatively high speed at the downstream end of a packaging flow line. Thus it is the first example which would be the most appropriate for working at a throughput of about 10 to 20 packages a minute as a manually fed machine. The first example includes two jaws one of which is movable and spring biased towards the other, a reel of adhesive tape, the adhesive tape from which passes between the jaws with its adhesive face towards and adhered to the movable jaw, and a reel of paper tape, the paper tape from which passes through a channel in the movable jaw into the space between the jaws where it is adhered to the end portion of the adhesive tape.

The machine also includes a pivoted abutment located beneath the jaws and connected to a knife for severing the two tapes to complete the adhesive tape ties.

In use, an operator forces the gathered together neck of a bag to be sealed between the jaws and against the adhesive face of the adhesive tape. As the gathered together neck of the bag is forced between the jaws they open, and further movement of the gathered together neck of the bag between the jaws peels the adhesive tape from the movable jaw and pulls further adhesive tape from the supply reel so that the gathered together neck of the bag is held in a loop of adhesive tape. Continued movement of the gathered together neck of the bag continues to peel the adhesive tape from the movable jaw and from the tape supply reel until all of the adhesive tape has been peeled away from the movable jaw, then the movement of the gathered together neck of the bag continues to pull adhesive tape from the supply reel and also pulls the paper tape attached to the end of the adhesive tape from the supply reel and through the channel in the movable jaw. As the gathered together neck of the bag leaves the space between the jaws they spring back together so bringing together the adhesive sides of the loop of adhesive tape passing around the gathered together neck of the bag and urging the paper tape against the adhesive side of the adhesive tape downstream of the channel in the movable jaw. Further downwards movement of the gathered together neck of the bag causes it to engage the pivoted abutment which, in turn, causes the cutter to move beneath the jaws to sever both the adhesive and paper tapes.

This machine does not seem to have been a great commercial success in spite of there being a significant market for manually fed bag tying machines which are capable of applying paper tabs to adhesive tape ties. It is thought that this may result from the construction of the device including the two jaws that are spring biased together. As the gathered together neck of the bag leaves the space between the jaws, and the movable jaw springs back towards the fixed jaw, not only does the adhesive side of the adhesive tape adhere to the paper tape downstream of the channel but it tends to adhere to the surface of the movable jaw upstream of the channel. This prevents further movement of the adhesive tape from the supply reel between the jaws so preventing further downward movement of the bag. Thus this adherence between the tape and the movable jaw prevents the bag reaching the pivoted abutment and so prevents the operation of the cutter to sever the tie from the tape supply reels. If the operator applies greater manual force to the neck of the bag the adhesive tape breaks and the tie is incorrectly formed.

According to this invention, a machine for applying adhesive tape ties to filled bags comprises an adhesive tape path leading from an adhesive tape supply reel, manually movable accommodation means which are located on one side of the adhesive tape path, which face the non-adhesive side of the adhesive tape which accommodate the gathered together neck of a bag and which control its movement through the machine, an adhesive tape support which is located on the other side of the adhesive tape path and which joins the adhesive tape path at a contact region, with substantially only line contact between them, a paper tape path leading from a paper tape supply reel into contact with the adhesive tape path immediately downstream of the contact region from the opposite side of the adhesive tape path, and a cutter arranged to sever the adhesive and paper tapes to complete the tie, the arrangement being such that in use, an operator urges the gathered together neck of a filled bag against the adhesive side of the adhesive tape and into the accommodation means, with continued manual movement of the gathered together neck of the filled bag moving the accommodation means and forming an adhesive tape tie around the neck of the filled bag, as further adhesive tape is drawn from the supply reel and past the support, line contact only being established in the contact zone between the adhesive side of the tape and the support to allow the bag and the accommodation means to continue to move freely until the tapes are severed.

The adhesive tape tie is formed in generally the same way and has the same configuration as that described in British Patent Specification No. 1 043 262, but both the manually movable accommodation means and the arrangement of the support and its line contact only with the adhesive side of the adhesive tape as it is drawn from the supply reel past the contact zone greatly improve the operation of the machine. After the gathered together neck of the filled bag is urged against the adhesive side of the adhesive tape and into the accommodation means and causes the accommodation means to start to move, the adhesive tape starts to bend and fold on itself with its non-adhesive side against itself. Thus, any tendency for the gathered together bag to unravel, urges the adhesive side of the adhesive tape into contact with the support upstream of the contact region. Thus, during further movement, the neck of the bag is surrounded by a loop of adhesive tape one part of which is adhered to the support and the other part of which leads to the supply reel. As both the neck of the bag and hence the accommodation means are moved further, the adhesive tape is peeled off the support until, finally, it is peeled away from the contact region. From now on, further movement of the neck of the bag and hence of the accommodation means draws the paper tape that is already attached to the free end of the adhesive tape which forms one end of the completed tie from its supply reel and draws adhesive tape from its supply reel past the contact region. Immediately downstream of the contact region the paper tape is brought into contact with the adhesive side of the adhesive tape to apply the paper tape to what is to become the other end of the tie and to apply paper tape to what is to become the free end of the adhesive tape and the one end of the next tie. Both the paper and adhesive tapes are then severed to complete the tie. The adhesive tape tie which is formed thus includes a single piece of paper tape which extends across both free ends of adhesive tape.

The particular form of adhesive tape tie that is formed has the further advantage that the adhesive tape tie is "pilfer-proof" because it is impossible to open the adhesive tape tie without tearing the single paper tab that extends across its free ends. Thus, it is immediately possible to see if anybody has tampered with the adhesive tape tie on a closed package.

Preferably the machine also includes means to print information onto the adhesive tape along its path from its supply reel. The adhesive tape printer is preferably of the hot foil blocking-type. The paper tape may additionally be printed with information along its path from its supply reel and there is a particular advantage in printing the paper tape since it is very much easier to print onto the paper tape than on the adhesive tape since the paper tape is absorbent and thus can be printed with a conventional printer using, for example, solvent inks. These would, of course, smudge if applied to the adhesive tape.

Preferably the accommodation means to accommodate the gathered together neck of a filled bag and control its movement through the machine is formed by a disc which includes a number of equiangularly spaced notches. In this case, the path of the neck of the bag through the machine is arcuate. Alternatively, the means to accommodate the gathered together neck of the bag may be formed by a flexible belt such as a rubber belt which includes equally spaced notches or by a sprocket-type chain or caterpillar track which carries a number of equally spaced notches.

The bag tying machine preferably includes indexing means to locate the accommodation means in positions with its notches against the bag entry position. The indexing mechanism preferably includes a release lever located adjacent the bag entry position so that as the operator places the gathered together neck of the bag into the accommodation means the indexing mechanism is released to allow the accommodation means to move under the manually applied load.

Preferably the cutter and, when it is included, the printer, are electrically operated typically by actuation of a solenoid. In this case, the indexing mechanism may also actuate a switch which is arranged to control the cutter and the printer. Preferably however, a pair of proximity switches are included adjacent the means to accommodate the gathered together neck of the bag and these are arranged so that, upon completion of each bag tying operation, as the next notch moves into position to receive the following bag and the accommodation means is locked into position by the return of the indexing mechanism they trigger the operation of the cutter and the printer.

The support is preferably spring-loaded so that it exerts a substantially constant force on the adhesive tape. This ensures that the adhesive side of the opposite sides of the loop of adhesive tape around the gathered together neck of the bag are urged into contact with one another to adhere to one another to form the tie and yet ensures that the passage of the gathered together bag through the machine is not prevented and the machine jammed by any irregularity such as part of the gathered together neck of the bag not being located completely within the accommodation means.

A spring-loaded abutment may be located immediately downstream of the contact region to ensure that the paper tape is urged against the adhesive side of the adhesive tape coming from the supply roll. Such a spring-loaded abutment also ensures that the adhesive sides of the loop of adhesive tape around the gathered together neck of the bag are firmly adhered together. This spring-loaded abutment may be completely independent from the support or, alternatively, the support may include a slot through which the paper tape is fed and, in this case, the contact region is immediately upstream of the slot and the portion of the support immediately downstream of the slot forms the abutment.

A particular example of a machine in accordance with this invention will now be described with reference to the accompanying drawings in which.

Figure 1:
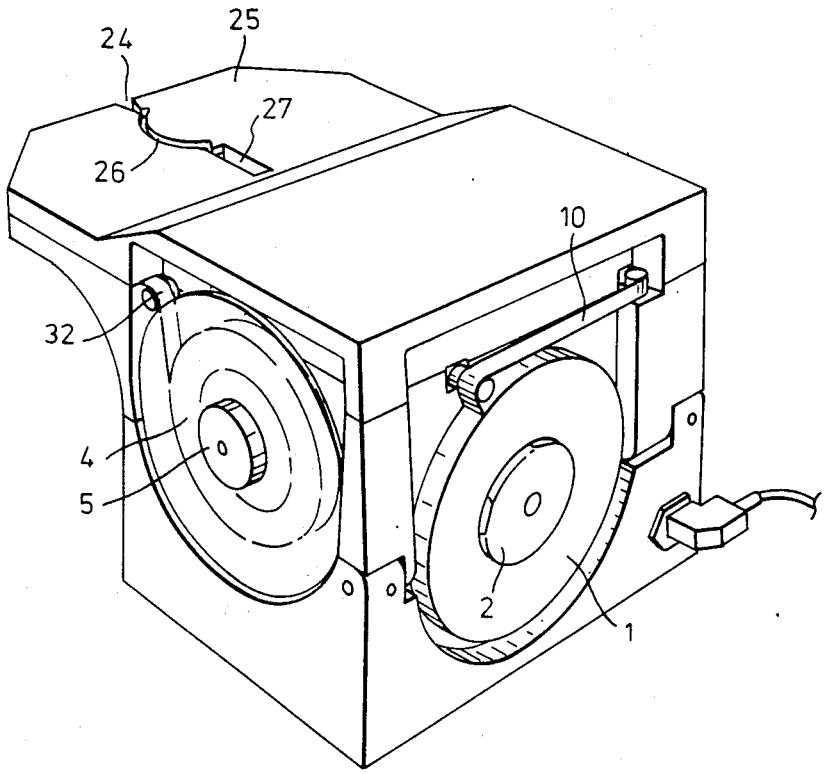
FIG. 1 is a perspective view from the rear and one side.

The bag tying machine comprises an adhesive tape supply reel 1, mounted on a holder 2, a printer 3, paper tape supply reel 4 mounted on a holder 5, a tie forming mechanism including a notched disc 6, and a solenoid operated cutter assembly 7.

The printer 3 is a hot foil blocking-type of printer comprising a heated die 8, heat transferable foil, (not shown) and a solenoid 9, which moves the heated die 8 and the heat transferable foil into contact with the non-adhesive side of adhesive tape 10 lead from the supply reel 1. The adhesive side of the tape 10 contacts a silicone rubber belt 11 which is freely movable around a pair of pulleys 12. The belt and adhesive tape are supported by a spring loaded platen assembly 13. The adhesive side of the tape 10 would normally adhere to the platen in a printer but the use of the freely rotatable silicone rubber belt 11 means that the adhesive tape 10 easily peels off the belt 11 during its movement through the printer 3.

Figure 2:
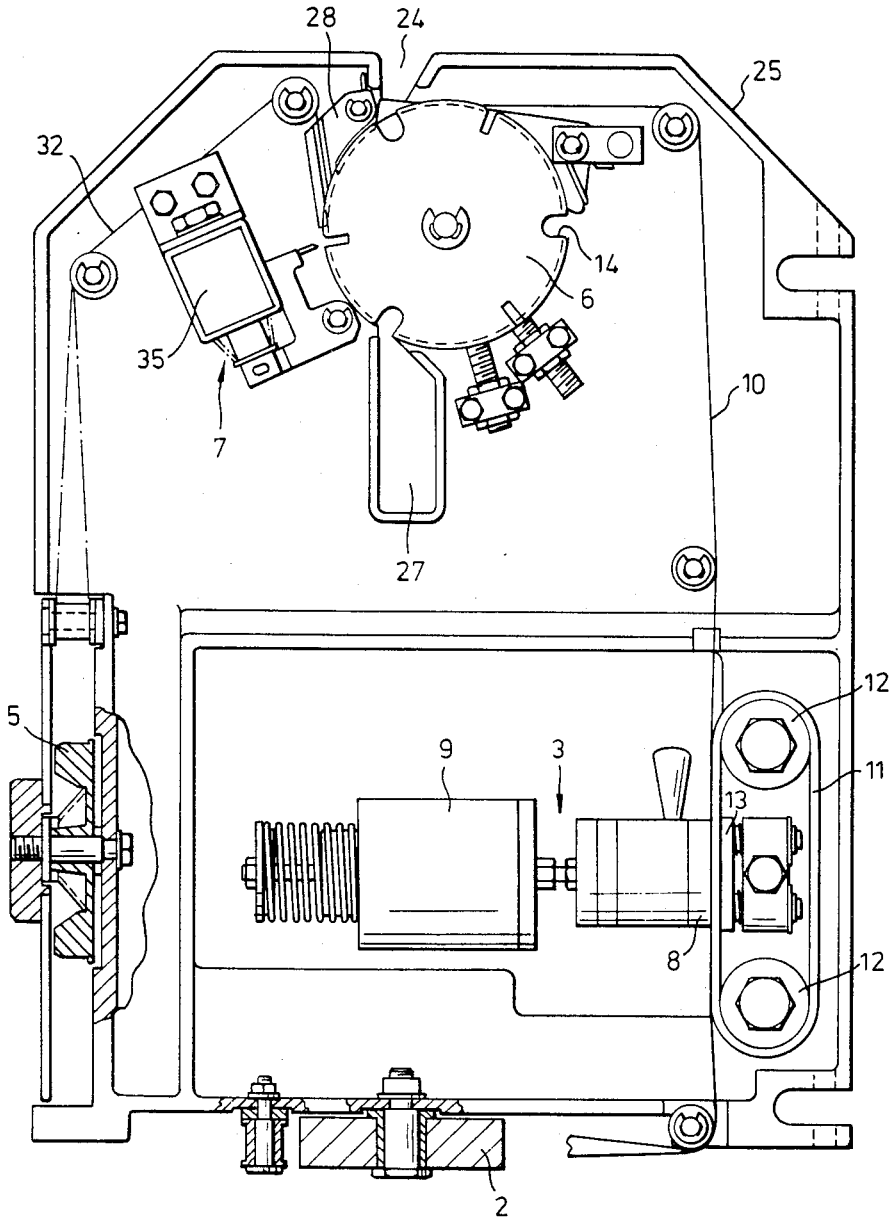
FIG. 2 is a plan with the lid removed.
Figure 3:
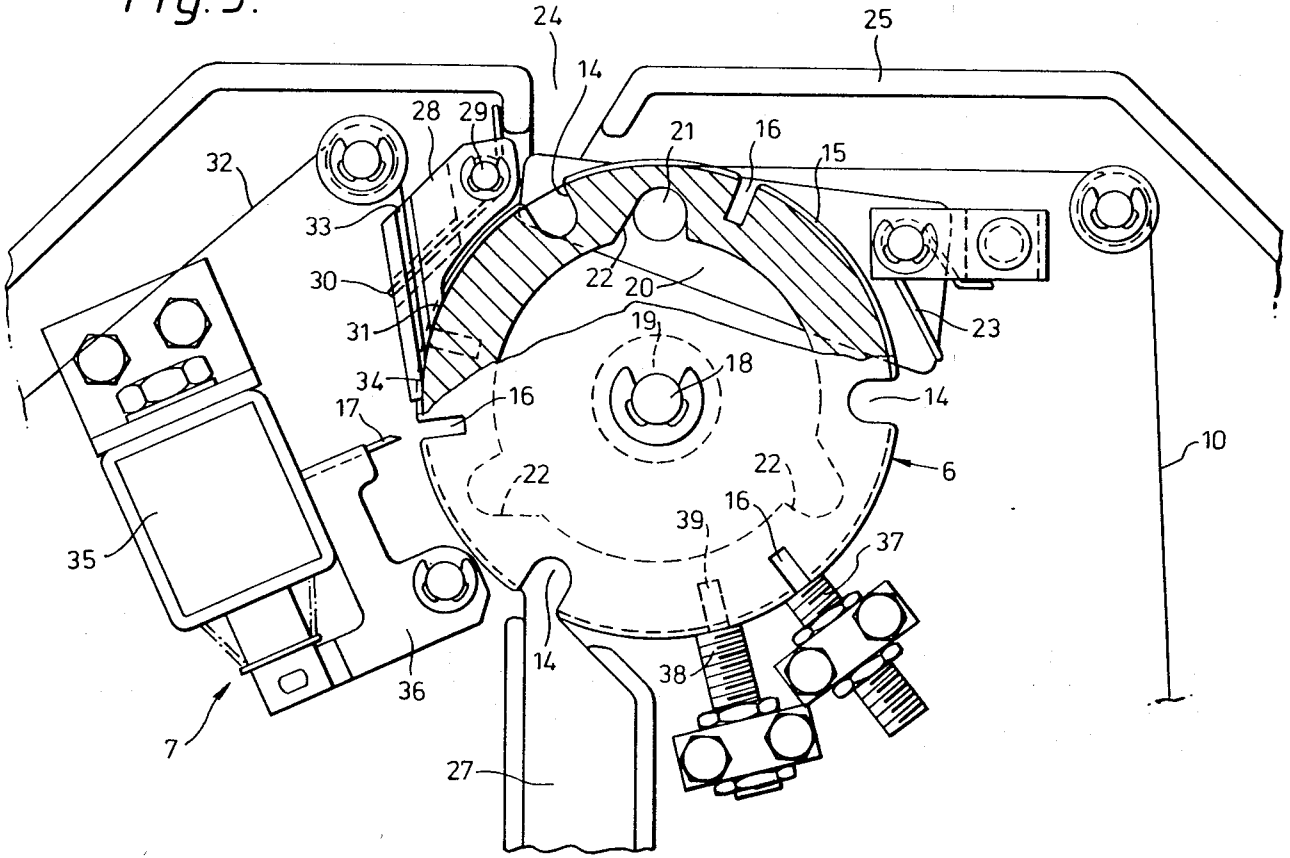
FIG. 3 is a plan of the tie forming part of the machine to an enlarged scale; and, FIGS. 4A to FIGS. 4H are a series of diagrammatic view of the tie forming mechanism showing the various stages in the formation of a tie.

The tie forming mechanism is shown more clearly in FIG. 3 and comprises the disc 6 which includes three equiangularly spaced notches 14 which in use accommodate the gathered together neck of a filled bag and a peripheral groove 15 which accommodates the adhesive tape 10. The disc 6 also includes slots 16 which accommodate a blade 17 of the cutter assembly 7. The disc 6 is mounted on a central shaft 18 via a one-way Torrington roller clutch 19. This allows the disc 6 to rotate freely in the anti-clockwise direction as seen in FIGS. 2 and 3 but prevents rotation in the clockwise direction. A pivoted lever 20 includes a detent 21 which engages notches 22 on an inner face of the disc 6. The lever 20 is biased by a spring 23 to urge the detent 21 towards and into the notches 22 of the disc 6. The side of the lever 20 is adjacent the notch 14 which is arranged to receive the next bag and adjacent a V-shaped bag entry notch 24 in a housing 25 of the machine. The V-shaped bag entry notch 24 leads into an arcuate portion 26 and then opens out into a generally rectangular portion 27 through which the neck of the bag is pulled after completion of the tie.

The bag tying mechanism also includes a support 28 which is free to pivot around a pivot 29 but is biased by a spring 30. The support 28 includes a stepped face adjacent the periphery of the disc 6. The free end of the stepped face is matched to the shape of the base of the groove 15 of the disc 6 at a contact surface 31 with substantially line contact between them. Adhesive tape 10 from the adhesive tape supply reel 1 after passage through the printer 3 is led into the groove 15 around the outer periphery of the disc 6 and between this and the support 28. The contact surface 31 thus establishes substantially line contact with the adhesive surface of the tape 10. Paper tape 32 from the supply reel 4 is fed through a slot 33 in the support 28 and into contact with the adhesive side of the tape 10 immediately downstream from the contact surface 31. The face of the support 28 downstream of the slot 33 is also matched to the base of the groove 15 so that the paper 32 and adhesive tapes 10 are sandwiched between the face 34 and the disc 6.

The cutter assembly 17 comprises a solenoid 35 and a bell crahk 36 carrying the cutting blade 17. Actuation of the solenoid 35 causes the bell crank 36 to pivot to urge the cutting blade 17 into the slots 16 in the disc 6. A pair of proximity switches 37 and 38 are located adjacent the periphery of the disc 6 and against one of the slots 16 and a bore 39. When both of the proximity switches 37 and 38 are adjacent a gap in the periphery of the disc 6, which only occurs when one of the notches 14 is adjacent the notch 24 and when the detent 21 is in one of the recesses 22 a connection is made in an electrical control circuit which actuates the solenoid 35 to cause the cutter 17 to sever the adhesive 10 and paper 32 tapes. The electrical control circuit also instigates a short delay and then actuates the solenoid 9 in the printer 3. Thus each time that the disc 6 moves into the position shown in FIG. 3 both the cutter assembly 7 and the printer 3 are actuated.

Figure 4A:
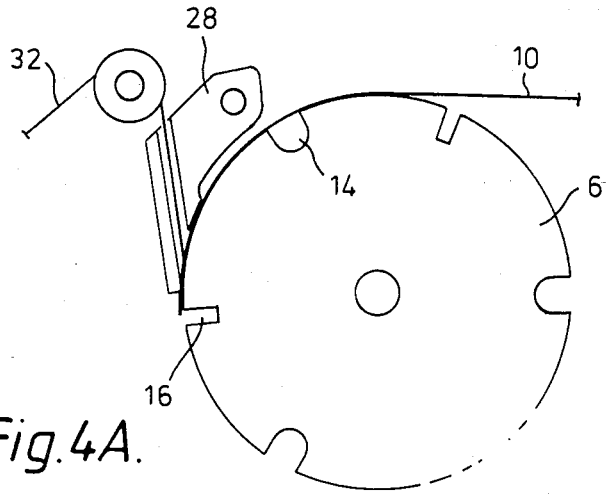
Figure 4B:
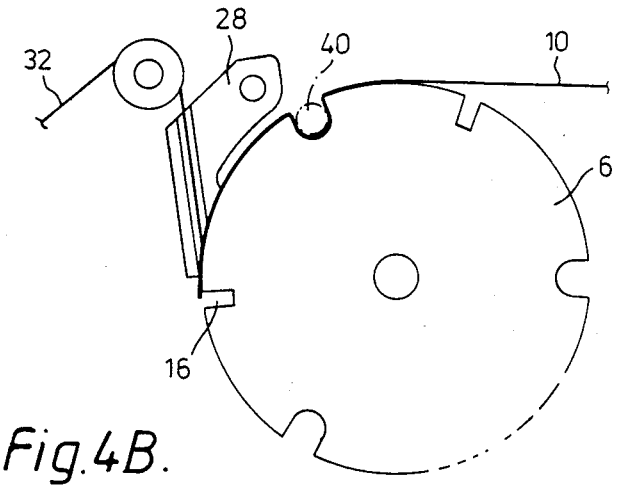
Figure 4C:
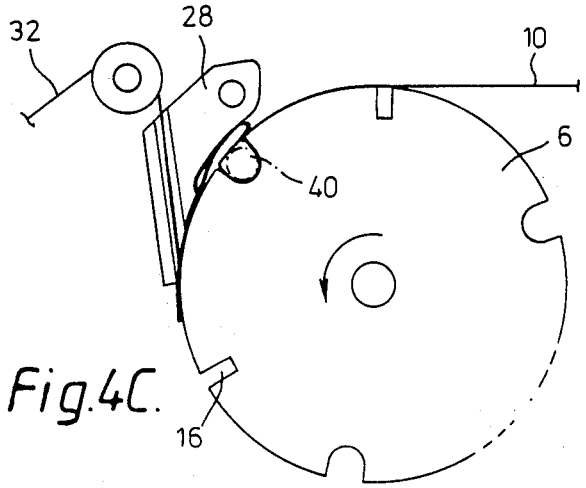
Figure 4D:
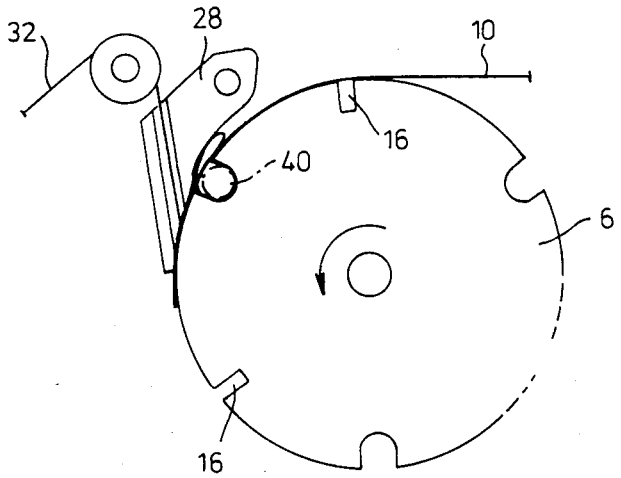

The operation of the machine in accordance with this invention will now be described with particular reference to the simplified diagrams shown in FIG. 4. FIG. 4A shows the relationship between the disc 6, the support 28 and the tapes 10 and 32 at the start of the bag tying operation. The gathered together neck 40 of a bag is when manually pushed into the bag inlet 24 and manually pushed against the adhesive side of the adhesive tape 10 and into the notch 14 as shown in FIG. 4B. In doing this, the gathered together neck 40 of the bag engages the lever 20 so disengaging the detent 21 and the recess 22. Further forward manual pressure causes the disc 6 to rotate in the counter clockwise direction as seen in FIGS. 2, 3 and 4, and since the neck 40 of a bag is held by an operator the neck 40 of the bag tends to turn with respect to the disc 6. The combination of this turning and forwards movement tends to urge the adhesive tape 10 into further contact with the support 28 and particularly with the portion of the stepped face remote from the disc 6 as shown in FIG. 4C so that the adhesive side of the adhesive tape 10 is brought into contact with a considerable extent of the support 28 and not just the contact surface 31 . Further forwards movement of the neck 40 of the bag causes rotation of the disc 6 and peels the adhesive tape from the surface of the support 28 as shown in FIG. 4D. Naturally, all the time that the disc 6 is rotating further adhesive tape 10 is being drawn from the supply reel 1.

Figure 4E:
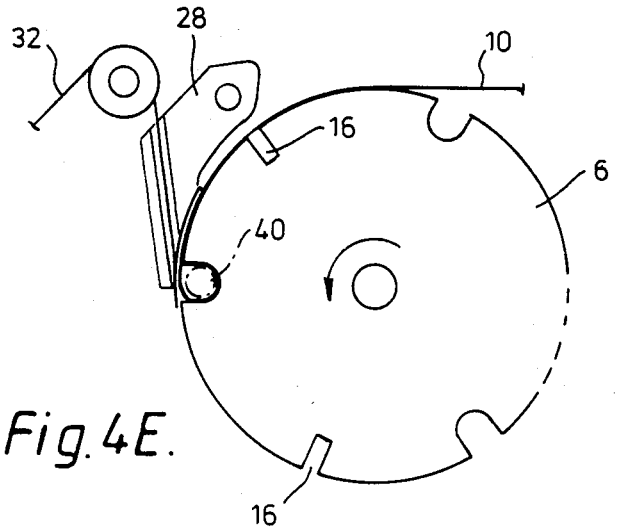
Figure 4F:
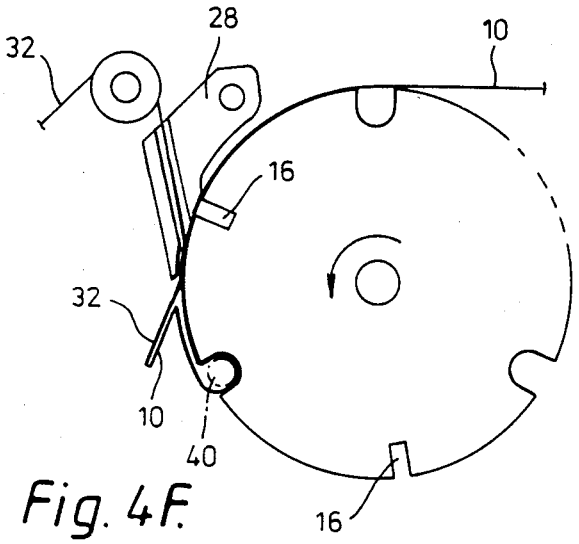
Figure 4G:
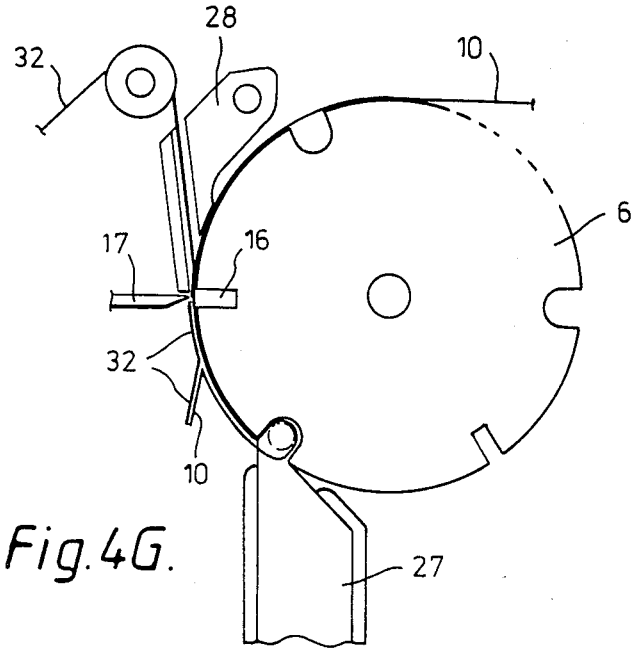
Figure 4H:
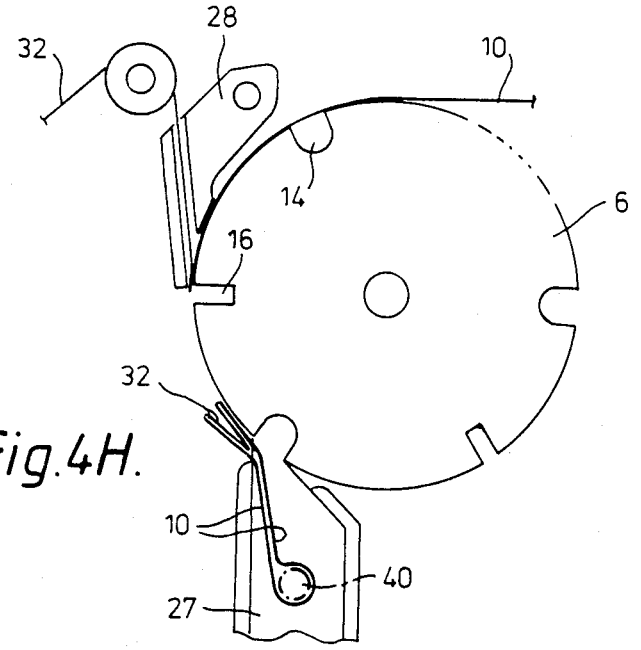

The forward manual movement of the gathered together neck 40 of the bag continues to rotate the disc 6 and peel more of the adhesive tape 10 from the support 28 until all of the adhesive tape that was initially attached to a support 28 is removed and this is the point shown in FIG. 4E. At this point, the contact surface 31 of the support 28 engages the adhesive surface of the adhesive tape 10 coming directly from the supply reel 1. Further movement of the gathered together neck 40 of the bag then starts to pull the paper tape 32 attached to the adhesive tape 10 from its supply reel. This further paper tape that is pulled from the supply reel 4 then adheres to the portion of the adhesive tape 10 between the gathered together neck 40 of the bag and the contact surface 31 of the support 28 as shown in FIG. 4F. Further manual movement of the gathered together neck of the bag 40 continues this operation until the detent 21 engages the next recess 22. As this occurs the recess 16 and the bore 39 are adjacent the proximity switches 37 and 38 and triggers the actuation of a solenoid 35 to move the blade 17 of the cutting assembly 7 into the slot 16 to sever both the paper 32 and adhesive 10 tapes and also cause the solenoid 9 in the printer 3 to print on the next section of adhesive tape 10. This is the position shown in FIG. 4G. As soon as the tapes 10 and 32 have been severed, the forward force on the gathered together neck 40 of the bag exerted by the operator causes the gathered together neck 40 of the bag to move into the space 27 as shown in FIG. 4H, and enables the neck of the bag to be pulled through the space 27 and be removed from the tying machine. The bag tying machine is then ready to receive the gathered together neck of the next bag to be tied and then the process is repeated.

I claim:

1. A machine for applying adhesive tape ties to gathered together necks of filled bags comprising:

an adhesive tape supply means for supplying adhesive tape having an adhesive and a nonadhesive side;

manually moveable accommodation means including means for accommodating a gathered together neck of a bag and controlling translation movement of said neck through said machine;

an adhesive tape support means for supporting said adhesive tape and including an upstream end and a downstream end, said upstream end being remote from said accommodation means and forming a space therewith, said downstream end being adjacent to said accommodation means;

a slot in said support means adjacent said downstream end;

paper tape supply means for supplying paper tape through said slot;

a cutter;

adhesive tape from said adhesive tape supply means following a path between said manually moveable accommodation means and said adhesive tape support means with said adhesive side of said adhesive tape facing said adhesive tape support means, said adhesive tape being in substantially line contact only with said downstream end of said adhesive tape support means;

said paper tape being supplied through said slot into contact with said adhesive side of said adhesive tape;

movement of said neck and said accommodating means causing the adhesive tape downstream from said neck to bow away from said accommodation means into said space and in contact with said upstream end of said adhesive tape support means, continued movement of said neck and said accommodation means forming an adhesive tape loop around said neck of said bag and causing further adhesive tape to be drawn from said supply means and past said support means with line contact only being established between said further adhesive tape and said adhesive tape support means whereby said bag and said accommodation means will continue to move freely as said tie is formed and said paper tape is applied to said tie, said cutter severing both said paper and said adhesive tape upon completion of said tie.

2. The machine of claim 1, including a hot foil blocking type of printer, said printer arranged to print information onto said non-adhesive side of said adhesive tape as said tape travels along its path from said supply means to said accommodation means.

3. The machine of claim 1, including switch means and wherein said cutter and said printer are electrically operated, and wherein movement of said accommodation means actuates switch means arranged for controlling said cutter and said printer and for actuating said cutter and printer upon completion of each bag tying operation.

4. The machine of claim 1, wherein said accommodation means comprises a rotatable disc including a plurality of equiangularly spaced notches arranged around its periphery.

5. The machine of claim 3, including indexing means for locating said rotatable disc in a position with a notch located adjacent a bag entry position.

6. The machine of claim 4, wherein said indexing mechanism comprises a release lever means located adjacent said bag entry position and operated by said neck for releasing said indexing means and permitting said disc to rotate when said gathered together neck of said bag is placed into said notch.

7. The machine of claim 1, including switch means and electrical means for operating said cutter, said movement of said accommodation means actuating said switch means and said electrical means to operate said cutter upon completion of each bag tying operation.

8. The machine of claim 1, wherein said downstream end of said adhesive tape support means is spring biased toward said accommodation means.

9. The machine of claim 8, including a spring loaded abutment means located immediately downstream of said slot for urging said paper tape against said adhesive side of said adhesive tape.

* * * * *